US007237764B2

(12) United States Patent
Despins

(10) Patent No.: US 7,237,764 B2
(45) Date of Patent: Jul. 3, 2007

(54) PIN BLOCK FOR CARPET GRIPPING DEVICES

(75) Inventor: Maurice Despins, Edmonton (CA)

(73) Assignee: Beno J. Gundlach Company, Belleville, IL (US)

( * ) Notice: Subject to any disclaimer, the term of this patent is extended or adjusted under 35 U.S.C. 154(b) by 0 days.

(21) Appl. No.: 10/876,850

(22) Filed: Jun. 25, 2004

(65) Prior Publication Data

US 2005/0161651 A1 Jul. 28, 2005

(51) Int. Cl.
*B65H 77/00* (2006.01)

(52) U.S. Cl. ..... 254/200; 294/8.6

(58) Field of Classification Search ..... 254/200, 254/209–212; 294/8.6
See application file for complete search history.

(56) References Cited

U.S. PATENT DOCUMENTS

| | | | | | |
|---|---|---|---|---|---|
| 634,471 | A | * | 10/1899 | Moser | 254/209 |
| 1,562,665 | A | * | 11/1925 | Wingate | 294/8.6 |
| 3,359,032 | A | * | 12/1967 | Kochanowski | 294/8.6 |
| 3,572,800 | A | * | 3/1971 | Graziano | 294/8.6 |
| 3,917,225 | A | | 11/1975 | Payson | |
| 3,952,997 | A | | 4/1976 | Whitlock | |
| 4,003,549 | A | | 1/1977 | Sergerie | |
| D245,665 | S | | 9/1977 | Klingensmith | |
| 5,190,328 | A | | 3/1993 | Anderson | |
| 6,595,565 | B2 | | 7/2003 | Whiting et al. | |
| 6,692,048 | B2 | | 2/2004 | Martin | |
| 2002/0047282 | A1 | | 4/2002 | Whiting et al. | |
| 2003/0107028 | A1 | | 6/2003 | Martin | |
| 2004/0069980 | A1 | | 4/2004 | Shannon | |
| 2004/0238001 | A1 | * | 12/2004 | Risden | 134/6 |

OTHER PUBLICATIONS

PCT/CA2005/000015, dated May 11, 2005, Written Opinion of ISA.
PCT/CA2005/000015, dated May 11, 2005, International Search Report.
Notification of Transmittal of International Preliminary Report on Patentability (Chapter II) for International Application No. PCT/CA2005/000015.

* cited by examiner

*Primary Examiner*—Emmanuel Marcelo
*Assistant Examiner*—Evan Langdon
(74) *Attorney, Agent, or Firm*—Sheridan Ross P.C.

(57) ABSTRACT

The present invention is concerned with a pin block for use with carpet gripping tools that comprise a plurality of downward extending pins that are canted towards the front of the pin block. Each pin is centered and supported in a pin support that forms an end surface thereby allowing only a pin tip to be exposed. Extending between each pair of pin supports is a fin that has a downward edge which is flush with the end surfaces of the pin supports to form a continuous contact surface that prevents the pin tips from penetrating through the carpet backing. Each pin block is adapted to stack together with other pin blocks to form ganged pin blocks to increase the gripping power of a carpet gripping tool comprising the present invention.

30 Claims, 6 Drawing Sheets

PIN BLOCK FOR CARPET GRIPPING DEVICES

FIELD OF THE INVENTION

The present invention is concerned with pin blocks for use with carpet gripping devices to grasp carpet without damaging the carpet backing or the underlay or membranes positioned beneath the carpet.

BACKGROUND OF THE INVENTION

In installing carpet, it is necessary to stretch the carpet across the floor in order for the installed carpet to lie flat and taut. Carpet installers often use gripping tools, such as knee kickers and other similar devices, in order to grip the carpet and stretch or move it into position. These devices use a gripping block having a multiple number of "nap teeth" which are closely-spaced together. The nap teeth are typically made of spring steel wire which grasps the loops of the carpet fibers to pull the carpet along. The gripping block is mounted in a carpet gripping tool to grasp the carpet as the carpet is manipulated into position with the tool. The problem with nap teeth is that fibers will pull out of the carpet and accumulate in the closely-spaced nap teeth thereby further reducing the gripping ability or "nap grip" of the block. Conventional nap teeth are also generally less effective in gripping "sheared" or "cut pile" carpet.

To grip these types of carpets, carpet tools also use heavy retractable pins in combination with the nap teeth. The pins can extend downward past the nap teeth to pierce the backing of the carpet, increasing the effective gripping power of the tool. The problem with these pins is that they can extend further through the carpet backing and tear the underlay as the carpet is stretched into position. Some carpets have water-blocking membranes as part of the backing. The use of knee kickers with retractable pins on these types of carpets can tear the membrane thereby destroying the water-blocking capability of the carpet.

It is, therefore, desirable to have a gripping block for use with carpet gripping devices that grasp the carpet without piercing through the carpet backing and tearing the underlay or membrane positioned underneath the carpet as it is stretched into position.

SUMMARY OF THE INVENTION

The present invention is concerned with a pin block for use with carpet gripping devices such as knee kickers and similar tools.

The present invention comprises a parallelopiped baseblock that has a plurality of pins extending downwardly from the bottom surface of the baseblock. The pins are linearly aligned in a single file along the bottom surface of the baseblock. Each pin extending from the baseblock is encased in a cylindrical pin support such that only the pin tip is exposed and protruding downward from the end surface of the pin support which is adapted for contacting a carpet backing. Each baseblock has between two to eight pin supports. Preferably, each baseblock has between four to six pin supports. In the preferred embodiment, the baseblock has five pin supports.

In the preferred embodiment, each pin support is canted towards the front surface of the baseblock as it extends downward. Preferably, the pin supports are canted at an angle of approximately 75° to approximately 45° with respect to the bottom surface. Ideally, this angle is approximately 60°.

In the preferred embodiment, there is a fin that extends between each adjacent pair of pin supports that intersects with the bottom surface. There is also a strengthening gusset extending between the bottom surface and the pin support closest to the front surface. Each fin has a downward edge that is flush with the end surface of the pin supports whereby the combination of the end surfaces and the downward edges of the fins form a single continuous contact surface that is substantially parallel to the bottom surface.

Preferably, the combination of the fins and the pins supports extends approximately ⅜" to approximately ⅝" downward from the bottom surface of the baseblock. Each pin tip extends approximately ⅛" from the end surface of its pin support.

Each baseblock has a protrusion extending from one side surface and a recess on the other side surface whereby the protrusion of one pin block can releasably interlock with the recess of another pin block. Therefore, a number of pin blocks can be releasably interlocked and aligned together to form a ganged pin block for a carpet gripping device, the ganged pin block having superior gripping power over a single pin block.

In operation, a number of pin blocks are stacked together side by side to form a ganged gripping block installed in a carpet gripping device. The ganged block is placed on the carpet with each pin tip piercing the carpet backing but the depth of penetration limited by the length of the pin tip and the contact surface formed by the fins and the end surfaces. The depth of the fins and pin supports is set to accommodate the typical height of the fibers of the carpet. The length of the pin tip is selected to penetrate the carpet backing but not to extend through the carpet backing and perforate any membrane on the bottom layer of the carpet backing or to tear the underlay as the carpet is stretched into position.

The carpet gripping device described above is typically a carpet stretching tool. One common form of such a tool is a knee kicker used by carpet installers to manipulate pieces of carpet into position. Knee kickers for use with the present invention have a pinrack in the front end of the device to receive a ganged pinblock. Each pinblock has a key slot on each of its front and rear surfaces for registering with a corresponding key in the pinrack of the knee kicker. The front and rear keys are preferably of a different size so as to prevent installing the ganged pinblock in the wrong orientation in the pinrack. It is anticipated that other carpet gripping devices may use the present invention as well. These other devices could include "seaming tools" used for squeezing pieces of carpet together so that they may be seamed together, carpet gripping devices for stretching and installing carpet on stairs, and "deadman stretchers" for positioning and stretching large pieces of carpet. It is envisioned that the present invention may be used with any carpet gripping device where it is desirable to grasp carpet without tearing loops of fibre from the carpet backing and without piercing through the backing of the carpet.

Broadly stated, the present invention is a pin block for use with a carpet gripping device, comprising, a baseblock having a bottom surface, the baseblock adapted for attaching to the carpet gripping device; a plurality of pin supports, each pin support extending downwardly a predetermined distance from the bottom surface to form an end surface, each pin support defining a longitudinal axis and adapted to support a pin; and a pin substantially centered in each pin support and aligned with the longitudinal axis of the pin support, each pin having a pin tip protruding downwardly a predetermined distance from the end surface of the pin support.

Broad stated, another embodiment of the present invention is a carpet tool comprising a pin block, wherein the pin block is comprised of a baseblock having a bottom surface, the baseblock adapted for attaching to the carpet gripping device; a plurality of pin supports, each pin support extending downwardly a predetermined distance from the bottom surface to form an end surface, each pin support defining a longitudinal axis and adapted to support a pin' and a pin substantially centered in each pin support and aligned with the longitudinal axis of the pin support, each pin having a pin tip protruding downwardly a pre-determined distance from the end surface of the pin support.

BRIEF DESCRIPTIONS OF THE DRAWINGS

FIG. 1 is a side elevational view of the present invention.

FIG. 1*a* is a cross-sectional view of the present invention along sections lined Ia-Ia.

FIG. 1*b* is a bottom plan view of the present invention.

FIG. 7 is a side elevational view of a knee kicker with a gripping block made from a plurality of the present invention with side cover on.

DETAILED DESCRIPTION OF THE PREFERRED EMBODIMENT

Figure 1A:
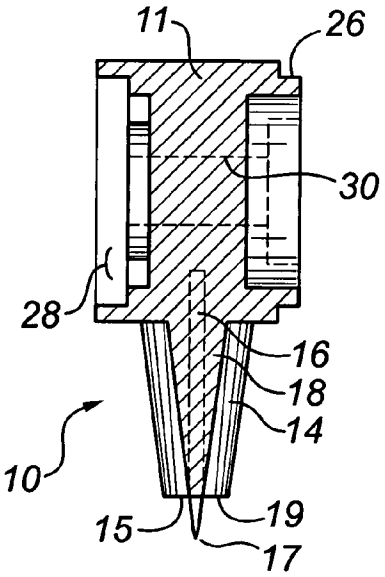
Figure 1:
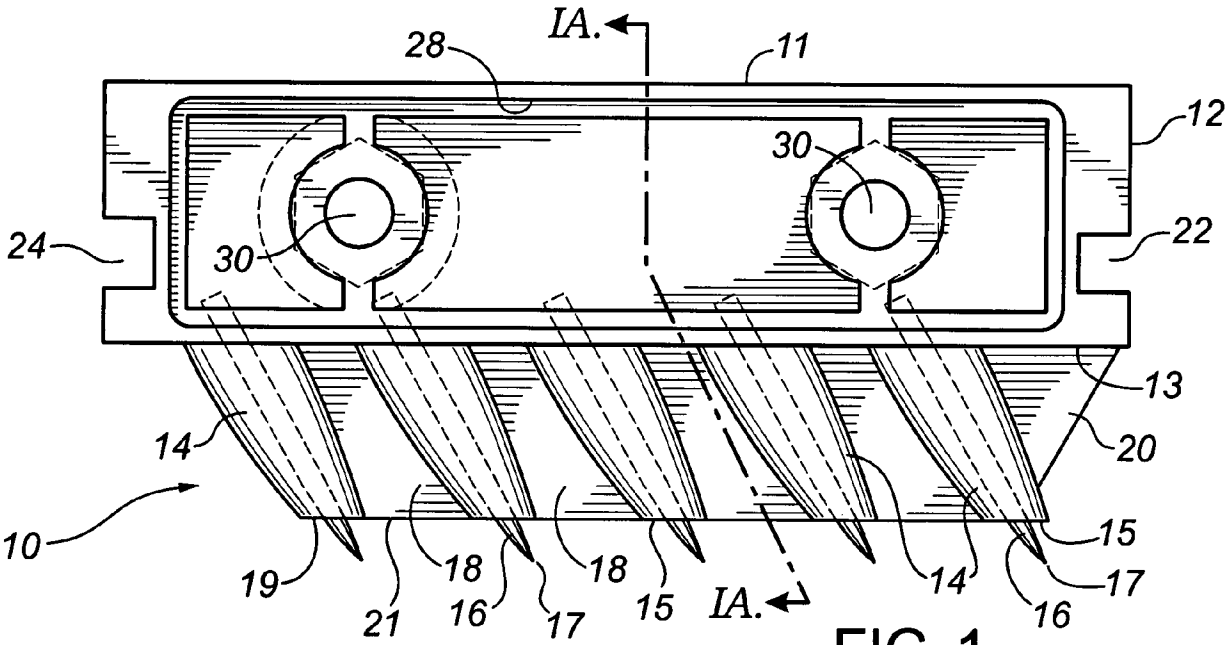
Figure 1B:
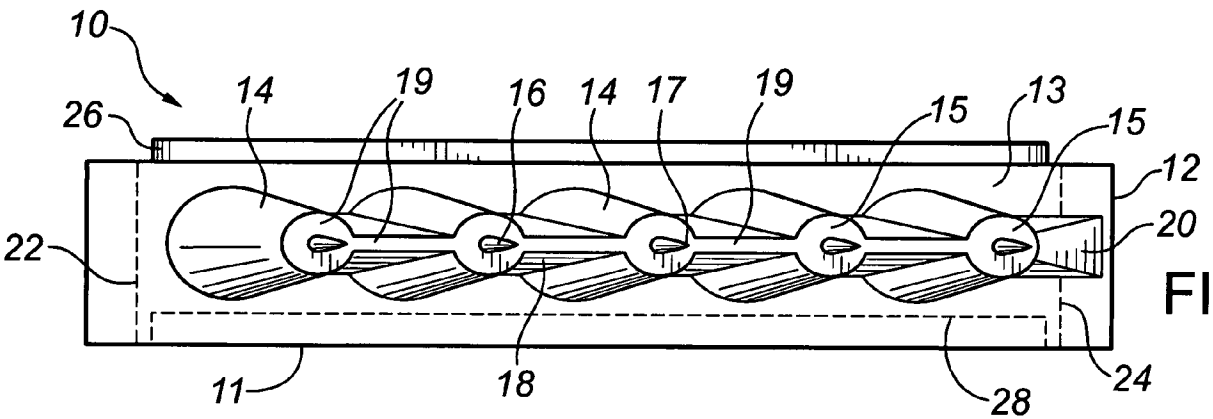
Figure 2:
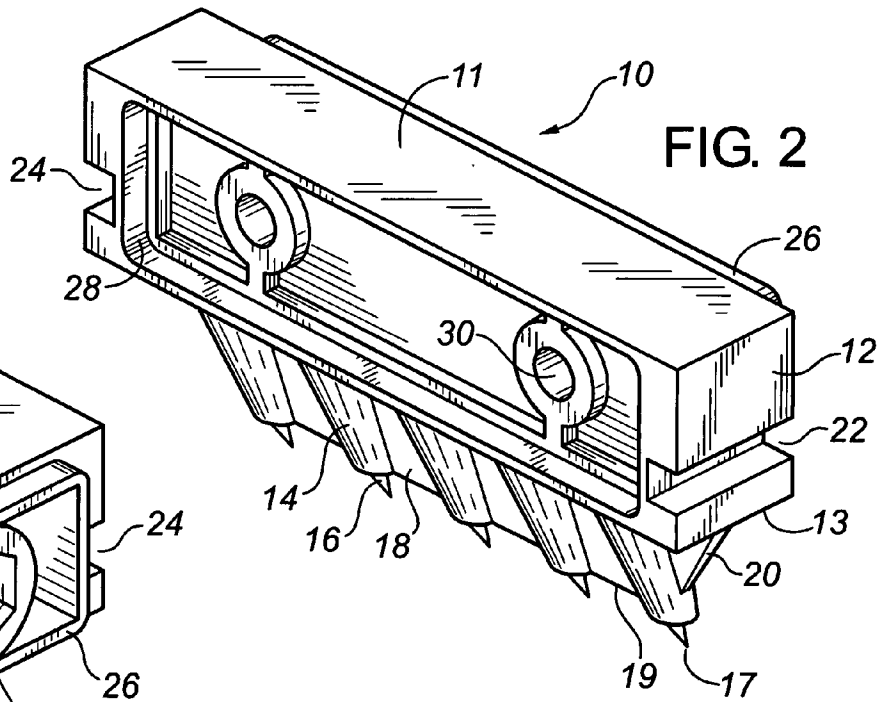
FIG. 2 is a right isometric view of the present invention.
Figure 3:
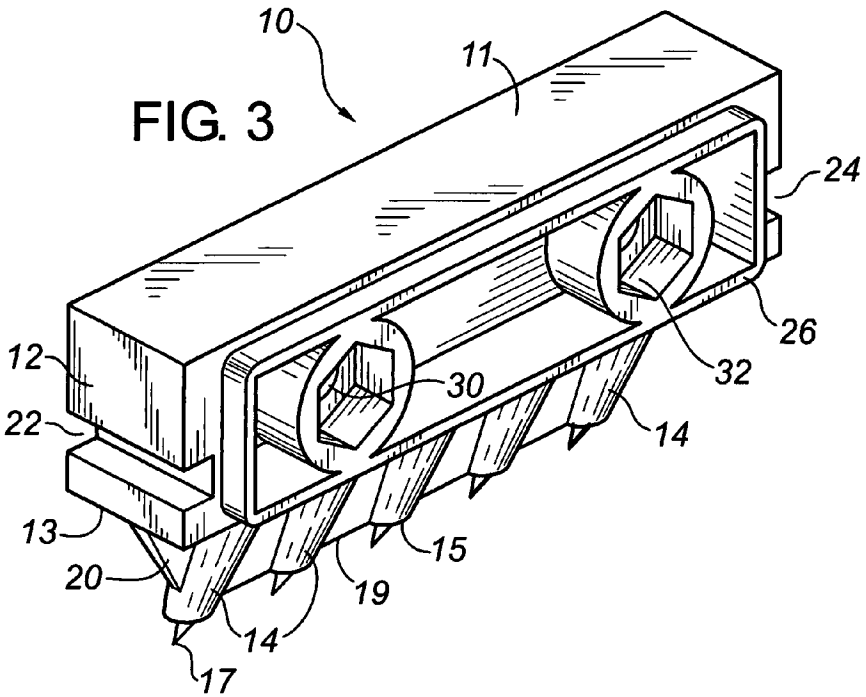
FIG. 3 is a left isometric view of the present invention.

The present invention is concerned with a pin block for use with carpet gripping devices such as knee kickers and similar tools.

Referring to FIGS. 1, 1*a*, 1*b*, 2 and 3, pin block 10 consists of parallelepiped baseblock 11 having a plurality of pin supports 14 extending downwardly from bottom surface 13 and canted or tilted towards front surface 12 of baseblock 11. Baseblock 11 can have as few as two and as many as eight pin supports 14. Preferably, pin block 10 has between four to six pin supports 14. Pin supports 14 are preferably cylindrical and taper, decreasing in diameter, to form end surface 15 which is adapted for contacting a carpet backing Centered within each pin support 14 and extending into baseblock 11 is a pin 16. Preferably, pin supports 14 are linearly aligned in a single file along bottom surface 13 and are canted at an angle between approximately 45° and approximately 75° with respect to bottom surface 13. In the preferred embodiment, this angle is set at approximately 60°.

The length of pin supports 14 are set such that end surfaces 15 are between approximately ⅜" and approximately ⅝" from bottom surface 13. The length of pin supports 14 is selected to allow for the length of the carpet fibers so that the bunching of the carpet fibers does not prevent pin block 10 from making complete contact with the carpet. Each pin 16 has a pin tip 17 that extends from end surface 15. Preferably, pin 16 range in diameter from 0.068" to 0.130". Pin tip 17 preferably extends approximately ⅛" from end surface 15.

In the preferred embodiment, each pair of pin supports 14 have a fin 18 extending between them which intersects with bottom surface 13. Fin 18 extends downward to form downward edge 21 which is flush with end surface 15. As shown in FIG. 1*a*, fin 18 is wedge-shaped having a thickness of approximately ⅛" where it joins bottom surface 13 and tapers to a thickness of approximately 0.040" at downward edge 21. The taper of fin 18 assists in deflecting carpet fibers away from pin supports 14 as pin block 10 is brought into contact with the carpet.

The combination of downward edges 21 of fins 18 and end surfaces 15 of pin supports 14 form contact surface 19 which is substantially continuous and parallel to bottom surface 13. Pin support 14 nearest front surface 12 has gusset 20 extending from it to intersect with bottom surface 13.

Figure 4:
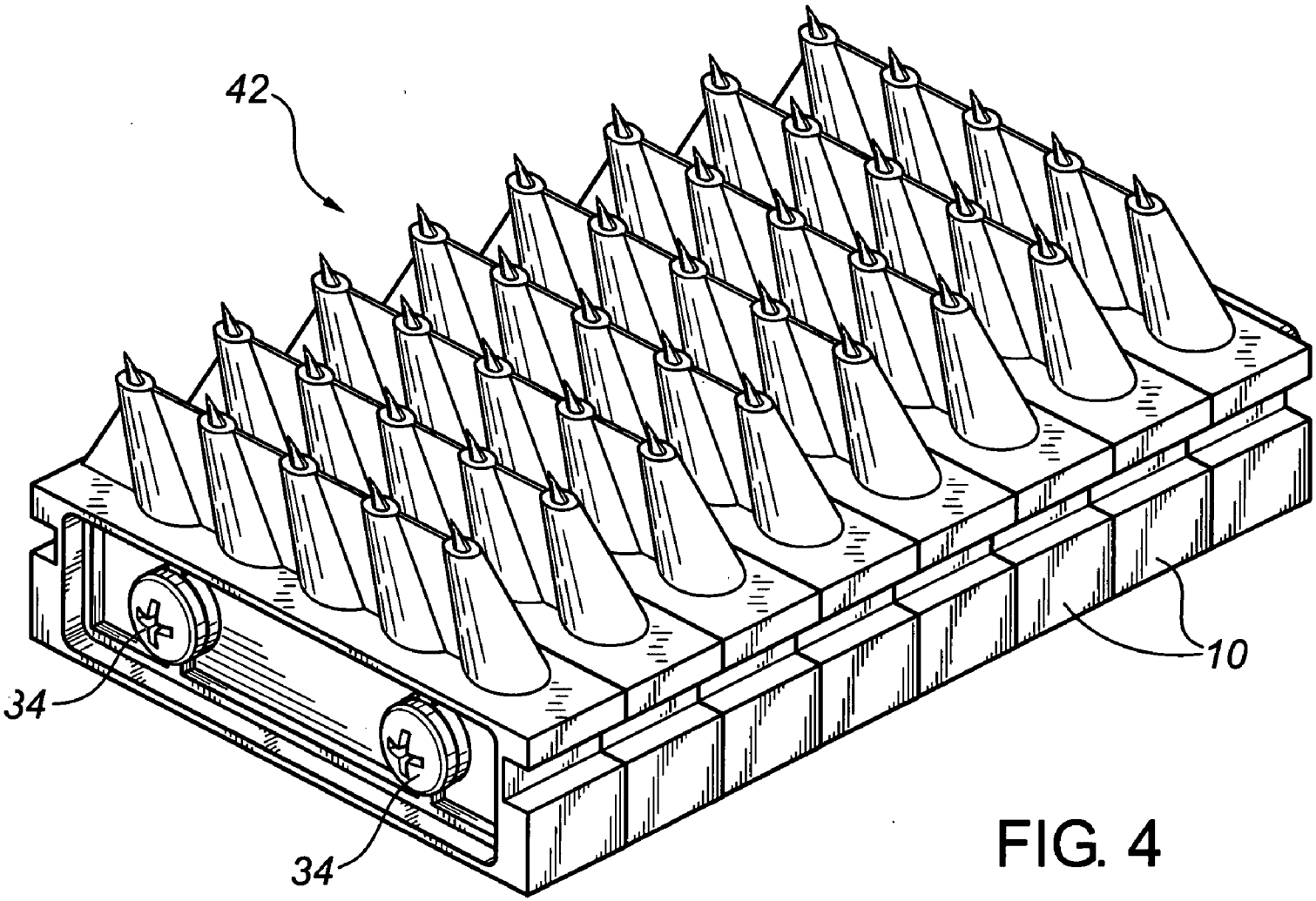
FIG. 4 is an isometric view of the bottom of a plurality of the present invention ganged together as a block
Figure 5:
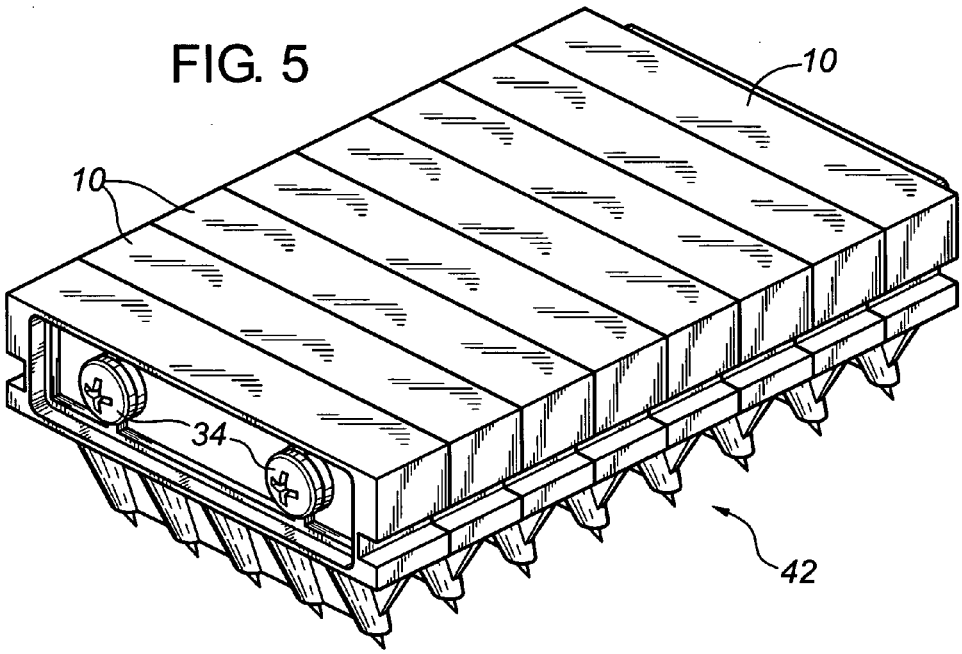
FIG. 5 is an isometric view of the top of a plurality of the present invention ganged together as a block
Figure 6:
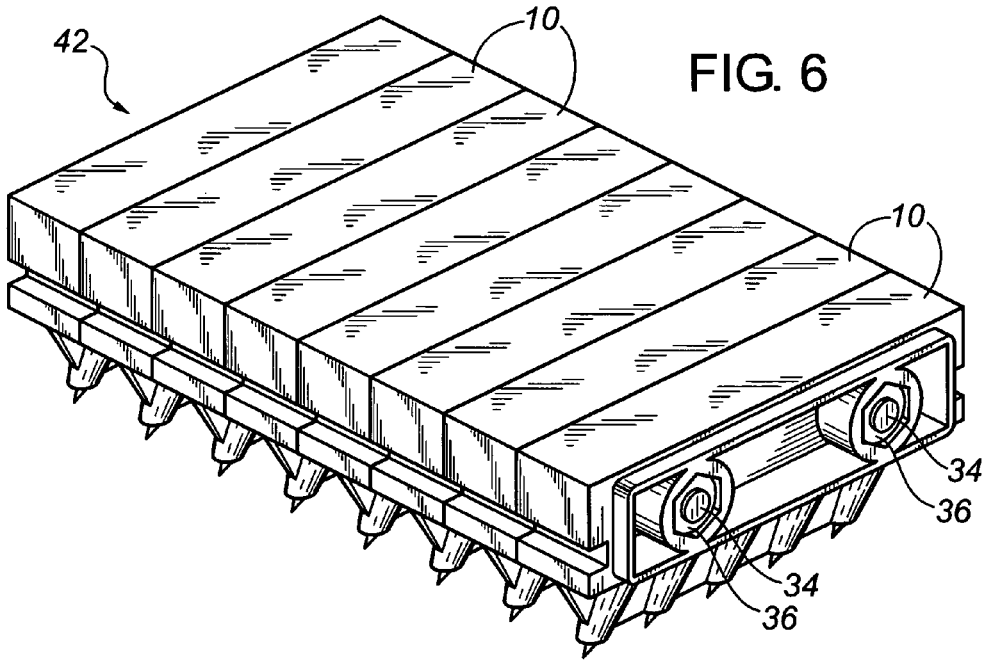
FIG. 6 is a left isometric view of top of a plurality of the present invention ganged together as a block.

In the preferred embodiment, pin block 10 is adapted to stack together with other pin blocks 10 to form a ganged block 42 for a carpet gripping tool as shown in FIGS. 4, 5 and 6. To accomplish that, each baseblock 11 has an interlocking protrusion 26 on a first side and a corresponding interlocking recess 28 on a second side. These sides are substantially parallel and extend upwardly from and intersect with bottom surface 13 of baseblock 11. Protrusion 26 of one pin block 10 releasably interlocks with recess 28 of another pin block 10 whereby the sides of pin blocks 10 are flush and aligned to one another when assembled into a ganged block 42. Each baseblock 11 also has boltholes 30 to accommodate a bolt 34 to pass through and bolt a plurality of pin blocks 10 together. On the side of pin block 10 with protrusion 26, there is a nut recess 32 to hold nut 36 in place. Upon assembling a ganged block 42, bolts 34 are placed through holes 30 and secured to nuts 36 in recesses 32.

Figure 7:
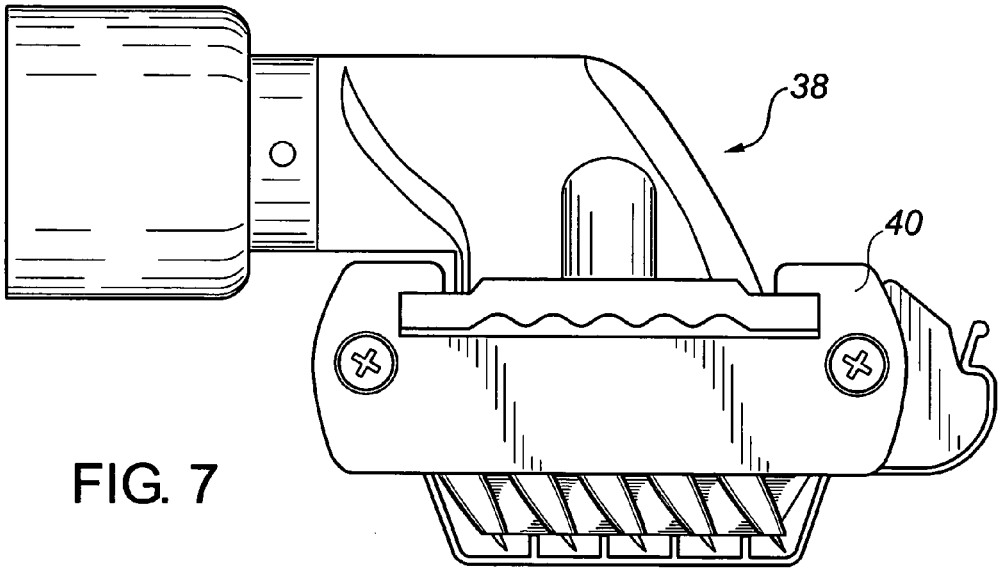
Figure 8:
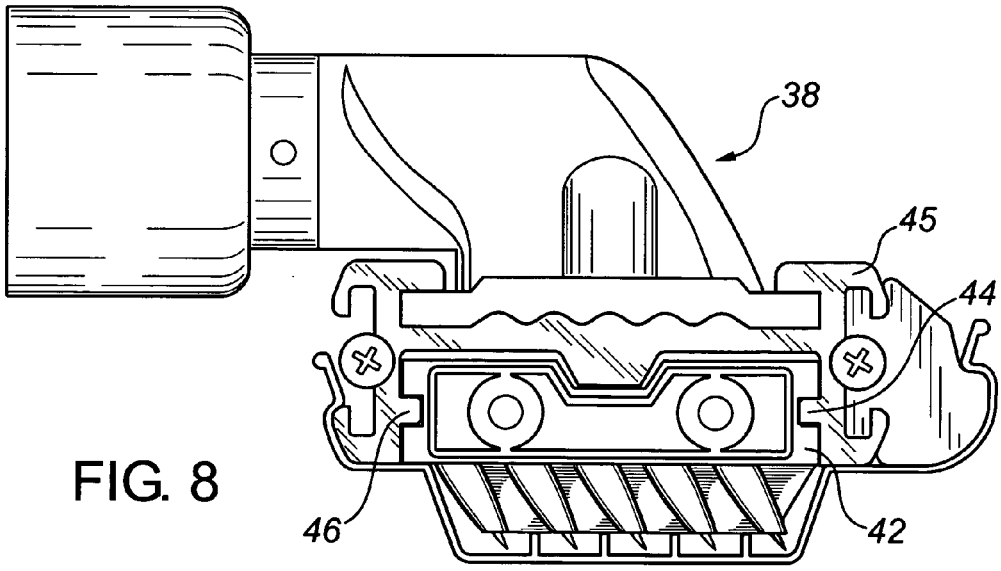
FIG. 8 is a side elevational view of a knee kicker with a gripping block made from a plurality of the present invention with side cover off.

Referring to FIG. 7 and 8, ganged pin block 42 is mounted in pinrack 45 of knee kicker 38. Removing side cover 40 allows ganged pin block 42 to slide into pinrack 45. Front slot 22 of each pin block 10 slide over key 44 whereas rear slot 24 of each pin block 10 slide over key 46. Keys 44 and 46 are sized differently so as to prevent ganged pin block 42 from being installed in pinrack 45 in the wrong direction or orientation.

Figure 9:
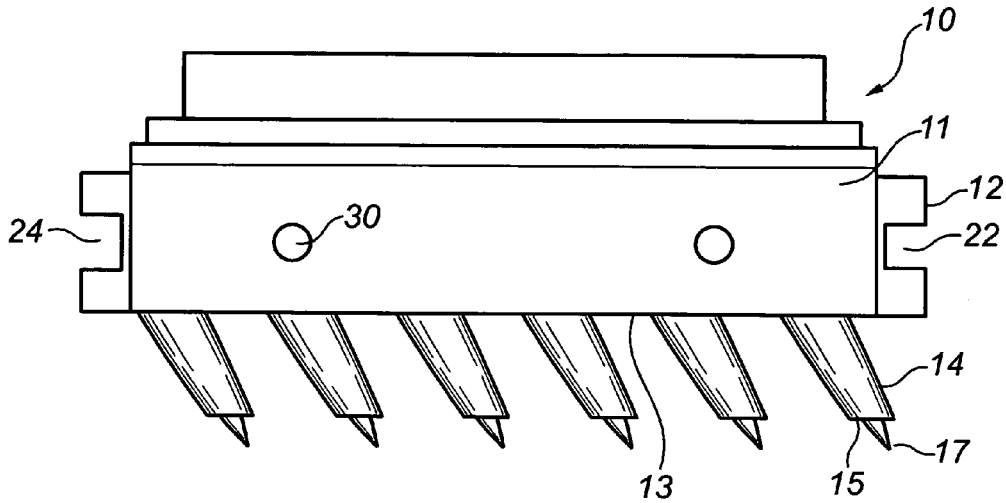
FIG. 9 is a side elevational view of an alternate embodiment of the present invention.

Referring to FIG. 9, an alternate embodiment of pin block 10 is shown. In this version, pin block 10 has no fins 18 extending between pin supports 14 nor does it have gusset 20 extending between the front pin support 14 and bottom surface 13.

Figure 10:
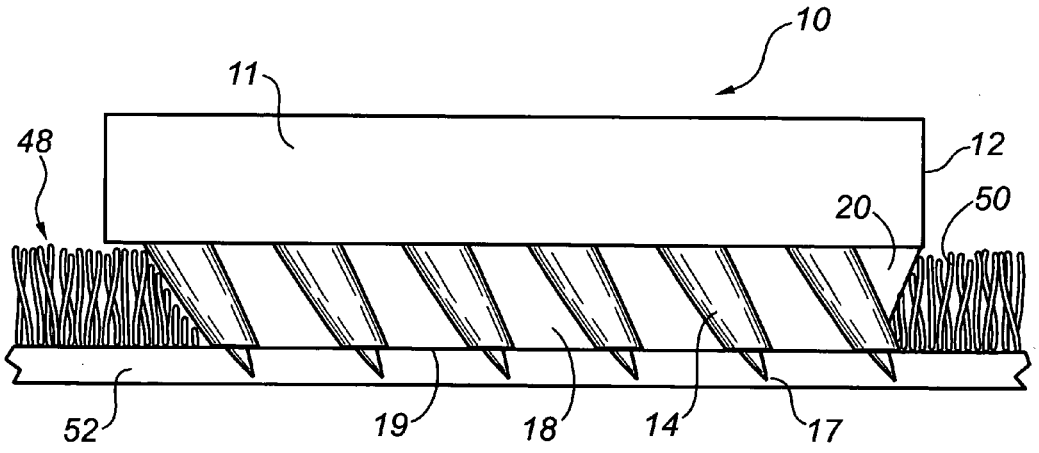
FIG. 10 is a side elevational view the present invention engaged with a piece of carpet.

In operation, pin block 10 is brought into contact with carpet 48 as shown in FIG. 10. Contact surface 19 of baseblock 11 pushes through pile 50 of carpet 48 and contacts backing 52 along contact surface 19. Contact surface 19 limits the depth that pin tip 17 penetrate backing 52 to the length of pin tip 17. The length of pin tip 17 is chosen so as to not extend through the thickness of backing 52 and tear any underlay or membrane layered underneath carpet 48. The advantage of the present invention is that pin block 10 grips carpet 48 by pushing backing 52 with pin tips 17 instead of pulling carpet 48 along by pulling piles 50 as done with conventional carpet tools that use nap teeth. This prevents piles 50 from being pulled out of backing 52 while providing a superior mechanism to grasp and stretch carpet 48 into position.

Although a few preferred embodiments have been shown and described, it will be appreciated by those skilled in the art that various changes and modifications might be made without departing from the scope of the invention. The terms and expressions in the preceding specification have been used therein as terms of description and not of limitation, and there is no intention in the use of such terms and expressions of excluding equivalents of the features shown and described or portions thereof, it being recognized as the scope of the invention as defined and limited only by the claims that follow.

The Embodiments of the Invention in Which and Exclusive Property or Privilege is Claimed are Defined as Follows:

1. A pin block for use with a carpet gripping device used for installing carpet having a carpet backing, the pin block comprising:

a) a parallelopiped baseblock having a bottom surface, the baseblock adapted for attaching to the carpet gripping device;

b) a plurality of pin supports, each pin support extending downwardly a predetermined distance from the bottom surface to form an end surface adapted for contacting the carpet backing, each pin support defining a longitudinal axis and adapted to support a pin, and c) a pin substantially centered in each pin support and aligned with the longitudinal axis of the pin support, each pin having a pin tip protruding downwardly a pre-determined distance from the end surface of the pin support, the length of the pin tip selected such that the pin tip will not extend through the carpet backing when the end surface is in contact with the carpet backing.

2. The pin block as set forth in claim 1 wherein the pin supports are linearly aligned.

3. The pin block as set forth in claim 1 wherein the baseblock has a front surface that extends upwardly from the bottom surface, and wherein each pin support is canted towards the front surface as it extends downwardly whereby each pin tip is canted towards the front surface at substantially the same angle.

4. The pin block as set forth in claim 3 wherein the pin tips are canted at an angle between approximately 90° and approximately 30° with respect to the bottom surface.

5. The pin block as set forth in claim 4 wherein the pin tips are canted at angle between approximately 75° and approximately 45° with respect to the bottom surface.

6. The pin block as set forth in claim 5 wherein the pin tips are canted at an angle of approximately 60° with respect to bottom surface.

7. The pin block as set forth in claim 1 further comprising:

a) a fin extending between each adjacent pair of pin supports and intersecting with the bottom surface; and b) a gusset extending between the bottom surface and the pin support nearest the front surface.

8. The pin block as set forth in claim 7 wherein each fin extends downwardly between its adjacent pair of pin supports to form a downward edge that is substantially flush with the end surfaces of the pin supports whereby the combination of the end surfaces of the pin supports and the downward edges of the fins form a continuous contact surface that is substantially parallel to the bottom surface.

9. The pin block as set forth in claim 1 wherein the number of pin supports range from 2 to 8.

10. The pin block as set forth in claim 9 wherein the number of pin supports range from 4 to 6.

11. The pin block as set forth in claim 10 wherein the number of pin supports is 5.

12. The pin block as set forth in claim 1 further comprising two parallel side surfaces that extend upwardly from and intersect with the bottom surface, one of the two side surfaces having a protrusion, the other of the two side surfaces having a recess whereby the protrusion of one pin block will releasably interlock with the recess of another pin block thereby permitting a plurality of pin blocks to be releas ably interlocked together to form a ganged pin block with all pin blocks having their bottom and front surfaces in alignment with each other.

13. A carpet tool comprising a pin block used for installing carpet having a carpet backing, wherein the pin block is comprised of:

a) a parallelopiped baseblock having a bottom surface, the baseblock adapted for attaching to the carpet gripping device;

b) a plurality of pin supports, each pin support extending downwardly a predetermined distance from the bottom surface to form an end surface adapted for contacting the carpet backing, each pin support defining a longitudinal axis and adapted to support a pin, and c) a pin substantially centered in each pin support and aligned with the longitudinal axis of the pin support, each pin having a pin tip protruding downwardly a pre-determined distance from the end surface of the pin support, the length of the pin tip selected such that the pin tip will not extend through the carpet backing when the end surface is in contact with the carpet backing.

14. The carpet tool as set forth in claim 13 wherein the pin supports are linearly aligned.

15. The carpet tool as set forth in claim 13 wherein the baseblock has a front surface that extends upwardly from the bottom surface, and wherein each pin support is canted towards the front surface as it extends downwardly whereby each pin tip is canted towards the front surface at substantially the same angle.

16. The carpet tool as set forth in claim 15 wherein the pin tips are canted at an angle between approximately 90° and approximately 30° with respect to the bottom surface.

17. The carpet tool as set forth in claim 16 wherein the pin tips are canted at angle between approximately 75° and approximately 45° with respect to the bottom surface.

18. The carpet tool as set forth in claim 17 wherein the pin tips are canted at an angle of approximately 60° with respect to bottom surface.

19. The carpet tool as set forth in claim 13 further comprising:

a) a fin extending between each adjacent pair of pin supports and intersecting with the bottom surface; and b) a gusset extending between the bottom surface and the pin support nearest the front surface.

20. The carpet tool as set forth in claim 19 wherein each fin extends downwardly between its adjacent pair of pin supports to form a downward edge that is substantially flush with the end surfaces of the pin supports whereby the combination of the end surfaces of the pin supports and the downward edges of the fins form a continuous contact surface that is substantially parallel to the bottom surface.

21. The carpet tool as set forth in claim 13 wherein the number of pin supports range from 2 to 8.

22. The carpet tool as set forth in claim 21 wherein the number of pin supports range from 4 to 6.

23. The carpet tool as set forth in claim 22 wherein the number of pin supports is 5.

24. The carpet tool as set forth in claim 13 wherein the pin block further comprises two parallel side surfaces that extend upwardly from and intersects with the bottom surface, one of the two side surfaces having a protrusion, the other of the two side surfaces having a recess whereby the protrusion of one pin block will releasably interlock with the recess of another pin block thereby permitting a plurality of pin blocks to be releasably interlocked together to form a ganged pin block with all pin blocks having their bottom and front surfaces in alignment with each other.

25. The carpet tool as set forth in claim 13 wherein the carpet tool is comprised of a carpet gripping device.

26. The carpet tool as set forth in claim 25 wherein the carpet gripping device is comprised of a carpet stretching device.

27. The carpet tool as set forth in claim 26 wherein the carpet stretching device is a knee kicker.

28. The carpet tool as set forth in claim 26 wherein the carpet stretching device is a deadman stretcher.

29. The carpet tool as set forth in claim 25 wherein the carpet gripping device is a carpet seaming tool.

30. The carpet tool as set forth in claim 25 wherein the carpet gripping device is a device for installing carpet on stairs.

* * * * *